US006298857B1

(12) United States Patent
Schmidt

(10) Patent No.: US 6,298,857 B1
(45) Date of Patent: Oct. 9, 2001

(54) HAND HELD PORTABLE CIGAR HUMIDOR

(75) Inventor: G. Gerry Schmidt, Newport Beach, CA (US)

(73) Assignee: Pacific Handy Cutter, Inc., Costa Mesa, CA (US)

( * ) Notice: Subject to any disclaimer, the term of this patent is extended or adjusted under 35 U.S.C. 154(b) by 0 days.

(21) Appl. No.: 08/956,545

(22) Filed: Oct. 23, 1997

Related U.S. Application Data

(63) Continuation-in-part of application No. 08/746,016, filed on Nov. 5, 1996, now Pat. No. 5,832,934.

(51) Int. Cl.[7] ..... A24F 13/24; A24F 17/00; A24B 1/02; A24B 3/02

(52) U.S. Cl. ..... 131/250; 131/303; 131/329; 206/236; D27/186; D27/187; D27/189

(58) Field of Search ..... 131/250, 290, 131/328, 329, 303; D27/186, 187, 189; 206/236, 270

(56) References Cited

U.S. PATENT DOCUMENTS

| | | | | |
|---|---|---|---|---|
| 23,579 | | 8/1859 | Walters . | |
| D. 147,120 | | 7/1947 | Dietrich | D85/2 |
| 335,435 | * | 2/1886 | De Silva | 131/250 |
| D. 355,275 | * | 2/1995 | Focke | D27/189 |
| D. 386,812 | * | 11/1997 | Schmidt | D27/187 |
| 827,558 | | 7/1906 | Niell . | |
| 1,021,849 | | 4/1912 | Schwieger . | |
| 1,061,236 | | 5/1913 | Fuller . | |
| 1,066,365 | | 7/1913 | Battin . | |
| 1,082,257 | | 12/1913 | Astruck . | |
| 1,086,463 | | 2/1914 | Robbins . | |
| 1,119,220 | | 12/1914 | Bates . | |
| 1,143,363 | | 6/1915 | Terwilliger . | |
| 1,166,881 | | 1/1916 | Anderson . | |
| 1,237,023 | | 8/1917 | Davidson . | |
| 1,273,264 | * | 7/1918 | Moran | 206/236 |
| 1,305,467 | * | 6/1919 | Hilpert | 206/236 |
| 1,450,674 | | 4/1923 | Marston . | |
| 1,509,311 | | 9/1924 | Perry . | |
| 1,770,920 | | 7/1930 | Hermani . | |
| 1,853,760 | * | 4/1932 | Davis | 206/270 |
| 2,010,440 | | 8/1935 | Ryan . | |
| 2,365,185 | | 12/1944 | Gailey | 299/24 |
| 2,862,779 | | 12/1958 | Hammond | 312/31.1 |
| 3,121,508 | * | 2/1964 | Kase | 220/39 |
| 3,395,787 | * | 8/1968 | Plaskan | 206/270 |
| 4,099,618 | * | 7/1978 | Ebner | 206/454 |
| 4,465,184 | * | 8/1984 | Bruce | 206/261 |
| 4,997,082 | | 3/1991 | Durocher | 206/204 |
| 5,011,009 | | 4/1991 | Scheurer | 206/270 |
| 5,277,315 | * | 1/1994 | Plein | 206/270 |
| 5,829,518 | * | 11/1998 | Wicker | 206/213.1 |

FOREIGN PATENT DOCUMENTS

| | | |
|---|---|---|
| 572673 | 3/1933 | (DE) . |

* cited by examiner

*Primary Examiner*—Stanley S. Silverman
*Assistant Examiner*—Jacqueline A. Ruller
(74) *Attorney, Agent, or Firm*—Oppenheimer Wolff & Donnelly LLP

(57) ABSTRACT

A hand held portable humidor including an upper housing and a telescopically interfitting lower housing, with a ridge structure integrally formed on the upper housing and adapted to secure both a cigar cutter and a belt clip mechanism to the upper housing. In a preferred embodiment, the lower housing is formed with substantially parallel ribs thereacross which contact the upper housing when the lower housing slides within the upper housing.

20 Claims, 7 Drawing Sheets

FIG. 6
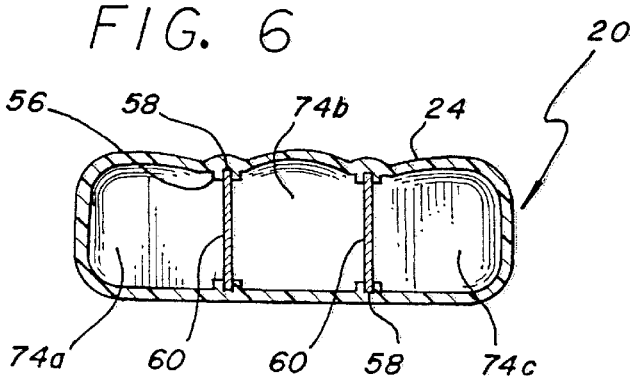
FIG. 7
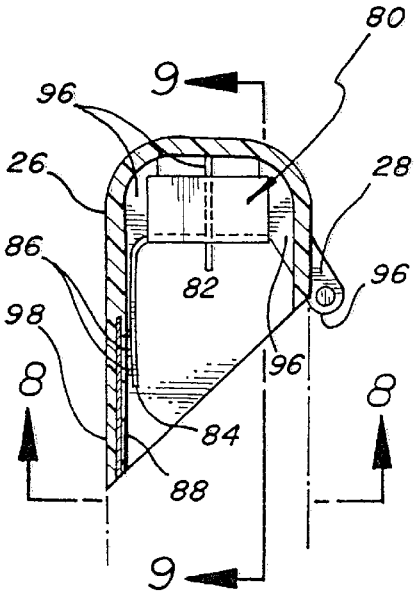
FIG. 8
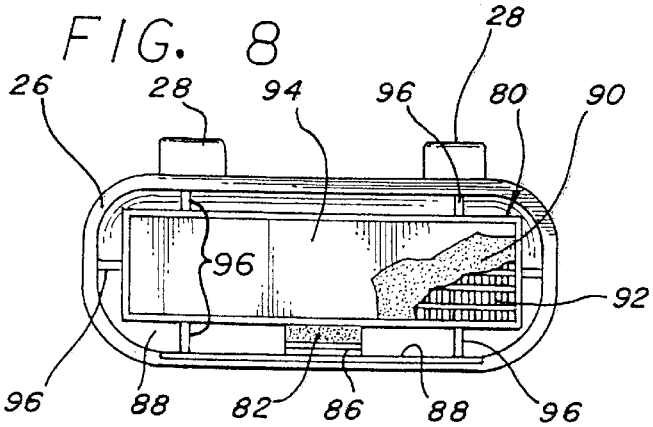
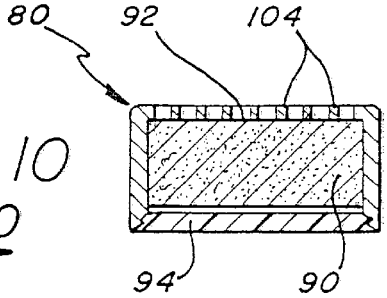
FIG. 10
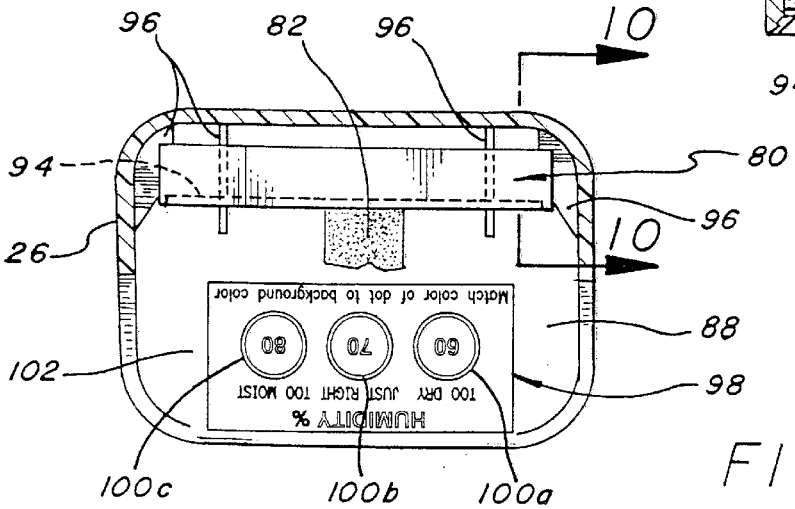
FIG. 9

FIG. 11
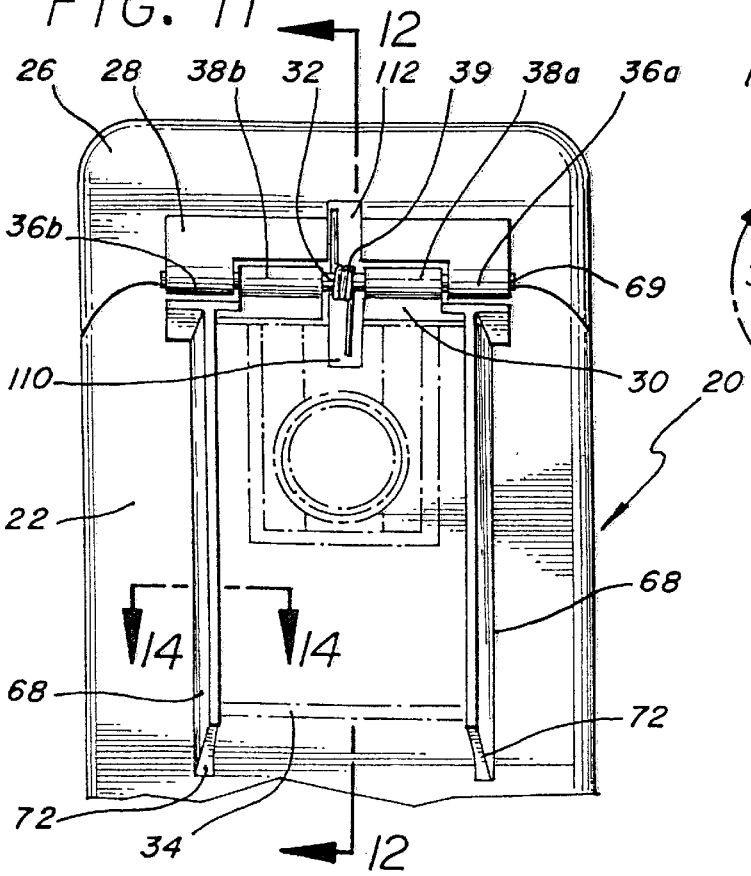
FIG. 12
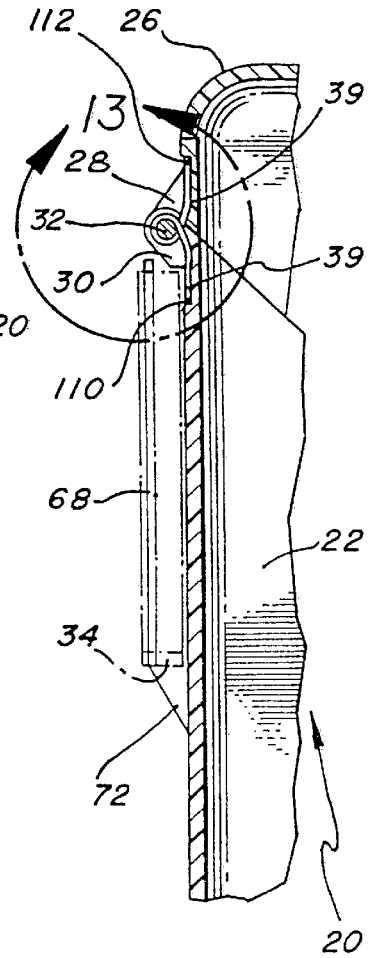
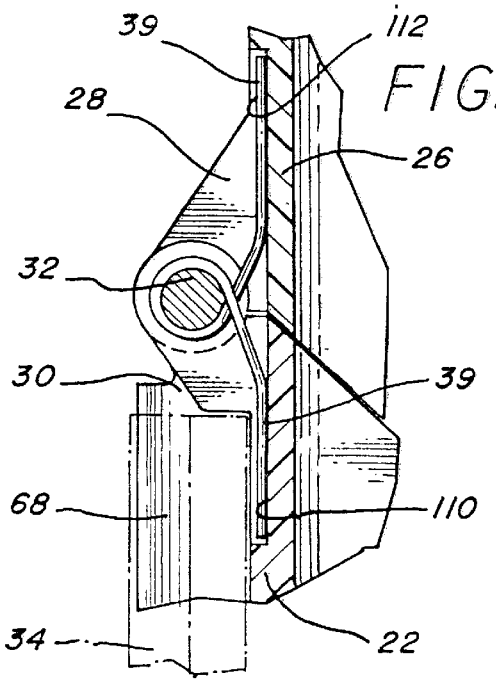
FIG. 13
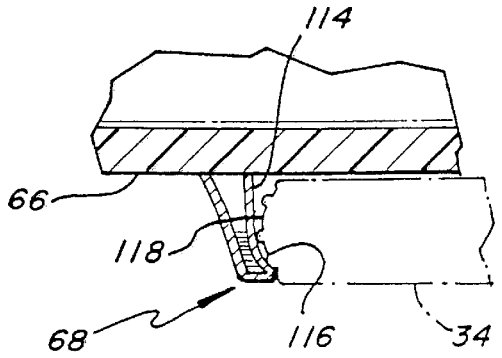
FIG. 14

HAND HELD PORTABLE CIGAR HUMIDOR

CROSS-REFERENCE TO RELATED APPLICATIONS

This is a continuation-in-part of U.S. patent application Ser. No. 08/746,016 by G. Gerry Schmidt filed on Nov. 5, 1996, now U.S. Pat. No. 5,832,934.

BACKGROUND OF THE INVENTION

1. Field of the Invention

The present invention relates to a hand held portable cigar humidor and, more particularly, pertains to a cigar humidor with an integrally formed ridge structure on its upper housing which is adapted to secure both a cigar cutter and a belt clip mechanism to the upper housing.

2. Description of the Related Art

Cigar aficionados have long known that some of the best cigars in the world are grown in tropical or equatorial areas and that such cigars are optimally aged in an environment where the relative humidity is high (approximately 70%). Accordingly, various humidifying devices and humidors have been employed in an attempt to replicate the humid climate where the cigar tobacco was grown. Known humidors include rooms and various boxes including humidifiers within which cigars are stored and aged. However, prior art humidors fail to address the need for a portable humidor within which cigars of various sizes may be safely transported without being damaged.

In order to optimize the smoking experience, cigar smokers additionally rely upon other equipment and tools, such as a cutter for properly removing the tip of a cigar. Significantly, the prior art is devoid of a hand held portable humidor including a detachable cigar cutter.

Optimally, a hand held portable cigar humidor would also include a mechanism for securing the humidor to an item of wearing apparel. Such a mechanism would preferably be streamlined, or "low profile", and particularly adapted for securing the humidor to a belt, waist of a pair of pants, pocket, or the like.

Additionally, it would be desirable to provide a portable cigar humidor which is adjustable to accommodate cigars varying in size, and which is designed to minimize the possibility of the cigars being damaged by unintented adjustments in the size of the humidor.

SUMMARY OF THE INVENTION

In accordance with a specific illustrative embodiment of the present invention, a hand held portable humidor with a humidifying material for maintaining a substantially constant relative humidity within the humidor includes an upper housing, a lower housing, a cigar cutter, a clip member and a ridge structure. The upper housing includes an exterior surface. The lower housing is formed of a material less rigid than the upper housing. The lower housing is telescopically fitted within the upper housing. The lower housing is sized sufficiently large relative to the upper housing and the material is sufficiently lubricative such that a sliding, substantially hermetic seal is maintained between the upper housing and the lower housing. The ridge structure is integrally formed on the exterior surface. The ridge structure is adapted to detatchably secure the cigar cutter and the clip member to the upper housing.

In another aspect of the present invention, the hand held portable humidor includes an upper housing and a lower housing. The upper housing includes a lid sized to receive humidifying material. The upper housing also includes an inwardly directed ridge. The lower housing is formed of a material less rigid than the upper housing. The lower housing includes at least one rib formed thereacross. The lower housing is telescopically fitted within the upper housing, with the at least one rib contacting the inwardly directed ridge when the lower housing is slid into the upper housing.

In another aspect of the present invention, the hand held portable humidor includes: a housing with an exterior surface; a lid pivotally secured to the housing and sized to receive humidifying material; a cigar cutter; a clip member; and a mechanism formed on the exterior surface for detatchably securing the cigar cutter and the clip member to the housing.

DESCRIPTION OF THE DRAWINGS

Other objects, features and advantages of the invention will become readily apparent upon reference to the following detailed description when considered in conjunction with the accompanying drawings, in which like reference numerals designate like parts throughout the figures thereof, and wherein:

FIG. 6 is a cross-sectional view of the exemplary cigar humidor taken along the plane 6—6 in FIG. 5;

FIG. 7 is a cross-sectional side view of a pivotally mounted lid of the exemplary cigar humidor shown in FIGS. 1 through 6;

FIG. 8 is a partial cross-sectional bottom view of the pivotally mounted lid taken along the plane 8—8 of FIG. 7;

FIG. 9 is a cross-sectional rear view of the pivotally mounted lid taken along the plane 9—9 of FIG. 7;

FIG. 10 is a cross-sectional side view of a humidifier enclosure of the cigar humidor taken along the plane 10—10 of FIG. 9;

FIG. 11 is an enlarged view of the upper housing and lid portions of the cigar humidor shown in FIG. 5; FIG. 12 is a cross-sectional side view of the cigar humidor taken along the plane 12—12 of FIG. 11;

FIG. 13 is an enlarged side view of the cigar humidor's hinge mechanism at circle 13 of FIG. 12;

FIG. 14 is a cross-sectional view of the cigar humidor and its attached cigar cutter taken along the plane 14—14 of FIG. 11;

DETAILED DESCRIPTION OF THE PREFERRED EMBODIMENTS

Figure 1:
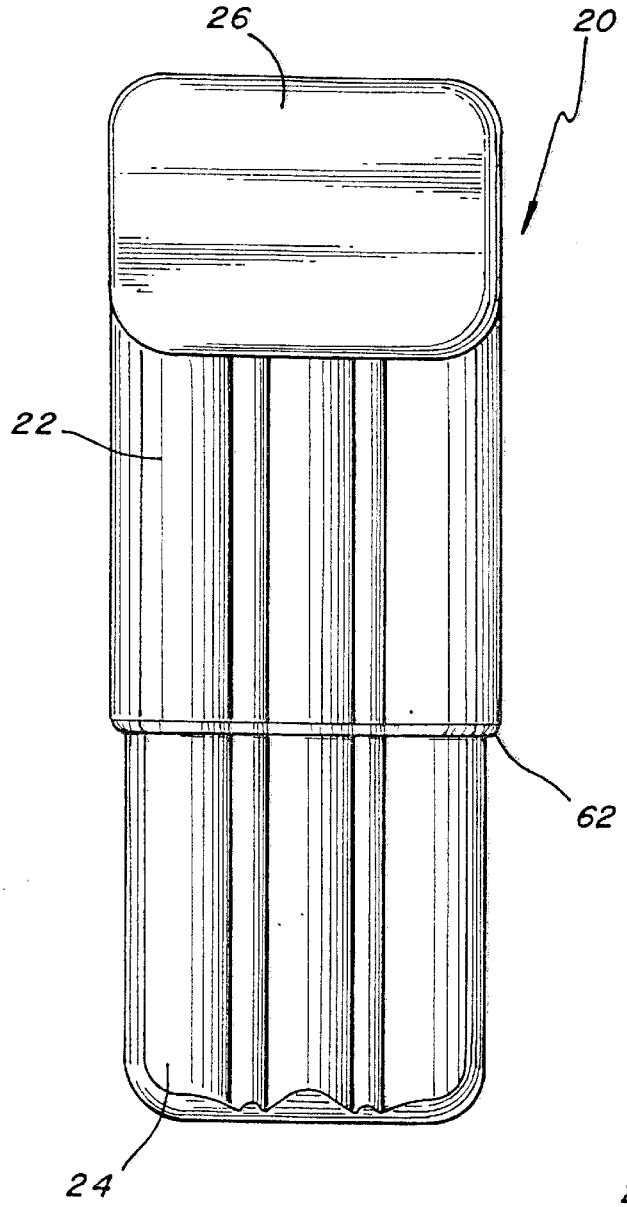
FIG. 1 is a front view of a preferred exemplary embodiment of a hand held, portable cigar humidor according to the present invention.
Figure 2:
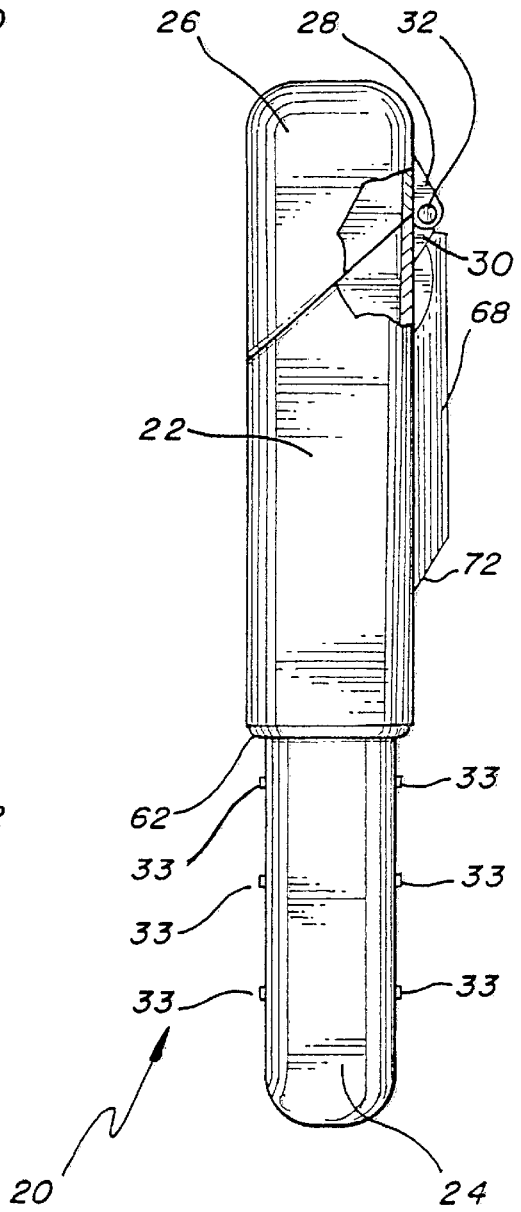
FIG. 2 is a partial cross-sectional side view of the cigar humidor shown in FIG. 1.

Referring initially to FIGS. 1 and 2, a preferred exemplary embodiment of the hand held, portable cigar humidor 20 of the present invention is illustrated in front and side views respectively. The cigar humidor 20 includes an upper housing 22 and a lower housing 24 which is telescopically fitted within the upper housing 22. The cigar humidor 20 also includes a lid 26 which is preferably, but not necessarily, pivotally secured to the upper housing 22.

A key aspect of the present invention is that the upper housing 22 and the lower housing 24 are formed in such a manner that a "sliding seal" is maintained between the upper housing 22 and the lower housing 24. A substantially hermetic seal is maintained between the upper housing 22 and the lower housing 24 by forming the upper housing 22 and the lower housing 24 from different materials as discussed below and by sizing the lower housing 24 to have an outer diameter which is greater than the inner diameter of the upper housing 22.

Generally, the lower housing 24 is formed of a material which is less rigid than the upper housing 22. The upper housing 22 is preferably formed from an ABS (Acrylonitrilebutadiene-sytrene) plastic or a similarly rigid and durable material. The lower housing 24 is preferably formed from a material such as Delrin which is sufficiently olefinic or otherwise lubricative. Preferably, the outer diameter of the lower housing 24 is approximately one mil larger than the inner diameter of the upper housing 22. Thus, through proper relative sizing of the upper housing 22 and the lower housing 24 and by selecting the respective materials from which they are formed as discussed above, a sliding seal is formed when the lower housing 24 is telescopically fitted within the upper housing 22. As a result, the humidor 20 is adjustable in length to accommodate cigars of varying lengths while retaining its substantially hermetic character.

As best seen in the partial cross-sectional side view of FIG. 2, the cigar humidor 20 illustrated includes an exemplary means for pivotally connecting or securing the lid 26 to the upper housing 22. Such a securing means includes a first hinge member 28 mounted to the lid 26, a second hinge member 30 mounted to the upper housing 22, and a pin 32.

As is also shown in FIG. 2, the upper housing 22 and lid 26 are preferably formed with complementary edges such that the upper housing 22 and the lid 26 fit together flush. When the lid 26 is in a closed position, the complementary edges should be aligned with no indentations resulting in a substantially hermetic seal being formed between the upper housing 22 and the lid 26. Additionally, the complementary edges are preferably contoured as shown (diagonally) so that the lid can be opened without damaging the cigars inside the humidor 20 and to facilitate easier access to the cigars.

FIG. 2 additionally illustrates a plurality of ribs 33 which are formed on the outside of the lower housing 24 in a preferred embodiment. The ribs 33 function to prevent or at least minimize the possibility of cigars inside the humidor 20 being damaged by unintented adjustments in the size of the humidor. The ribs 33 and the function which they perform are discussed below in greater detail with reference to FIG. 5.

Figure 3:
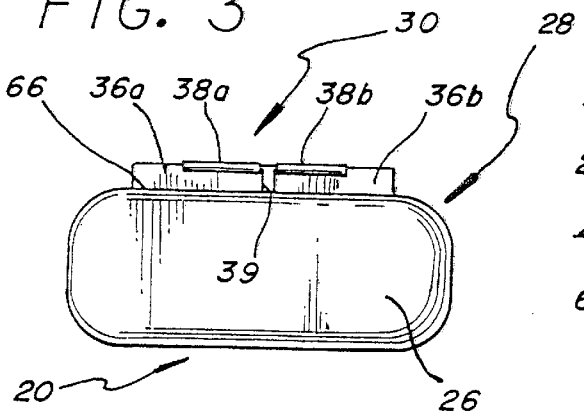
FIG. 3 is a top view of the cigar humidor shown in FIG. 1.

Referring now to FIG. 3, which is a top view of the cigar humidor 20, the first hinge member 28 includes two outer sleeve portions 36*a*, 36*b*. The second hinge member 30 includes two inner sleeve portions 38*a* and 38*b*. The two outer sleeve portions 36*a*, 36*b* abut opposing ends of the inner sleeve portions 38*a*, 38*b* when the lid 26 is assembled to the upper housing 22 by installing the pin 32 through portions 36*a*, 36*b*, 38*a*, and 38*b*. As discussed in greater detail with reference to other figures, the means for pivotally connecting or securing the lid 26 to the upper housing 22 also includes a spring member 39 which exerts a force on the lid 26 tending to force the respective complementary edges of the upper housing 22 and the lid 26 together. It should be understood that the lid 26 may be secured to the upper housing 22 by other mechanical means. For example, the lid 26 and the upper housing 22 may be formed such that the two "snap fit" together. By way of further example, the upper housing 22 and lid 26 may be cylindrically shaped such that threads or the like may be employed to facilitate a "twist on" means of securing the lid 26 to the upper housing 22.

Figure 4:
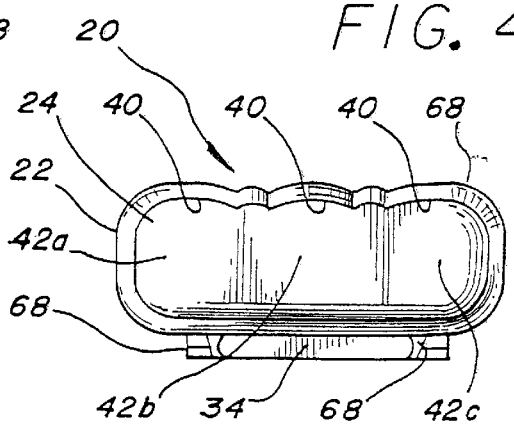
FIG. 4 is a top view of the cigar humidor shown in FIG. 3 with the pivoted lid removed.

As best shown in FIG. 4, the upper housing 22 is contoured to receive a plurality of cigars. A contoured inner surface 40 of the upper housing 22 defines a plurality of cylindrical portions 42*a*, 42*b*, 42*c* of the humidor 20. Preferably, a single, properly sized cigar is stored within each of the cylindrical portions 42*a*, 42*b*, 42*c*. A cigar which is too narrow in gauge may contact or collide with the inner surface 40 resulting in damage to the outer leaf of the cigar. It should also be appreciated that the humidor 20 may be designed to store a smaller or larger number of cigars than three. Furthermore, the arrangement of the cylindrical portions 42 is not necessarily linear.

Figure 5:
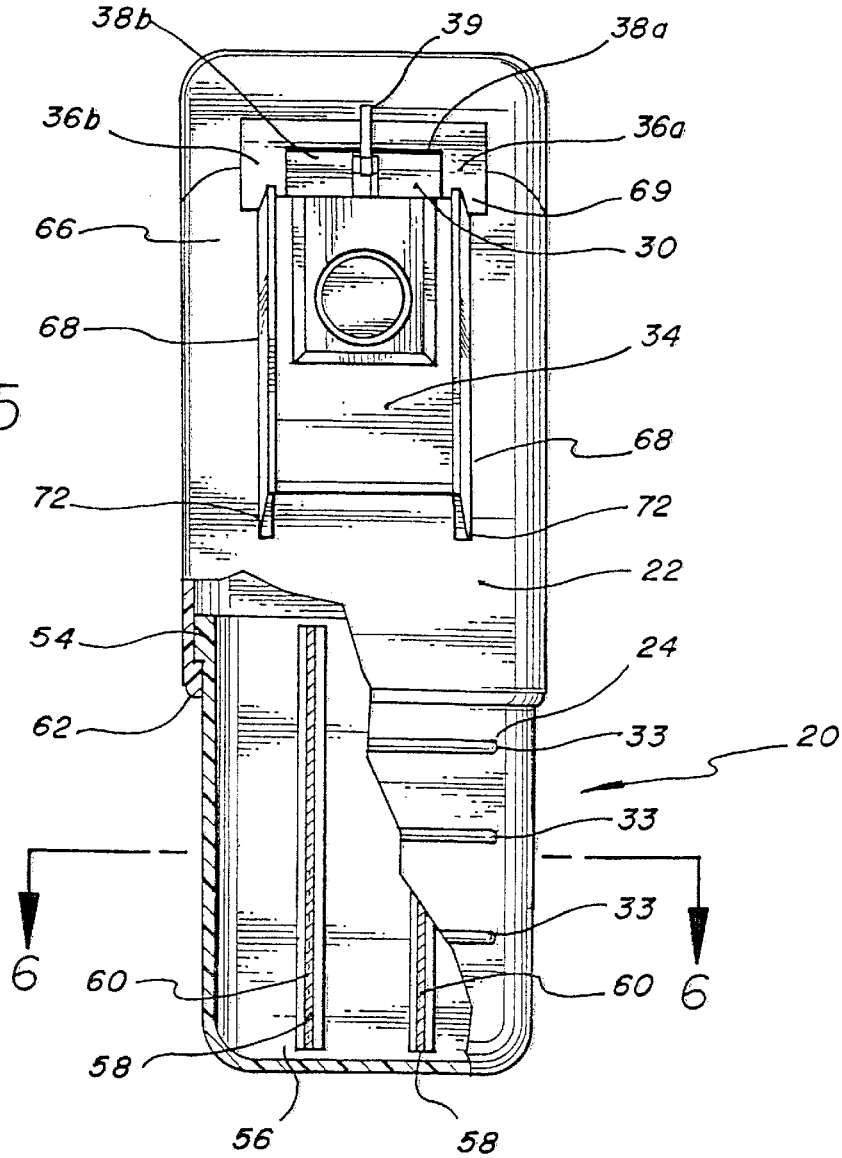
FIG. 5 is a partial cross-sectional rear view of the preferred embodiment of the hand held, portable cigar humidor of the present invention.

The humidor 20 is shown in FIGS. 1, 2 and 5 is in a fully extended configuration. As shown in FIG. 5, the lower housing 24 includes an interior surface 56 defining slots 58 for receiving partition members 60. The upper housing 22 includes an inwardly directed ridge 62 circumferentially formed therearound at the end of the upper housing 22 which is fitted over the lower housing 24. The lower housing 24 includes an outwardly directed ridge 64 circumferentially formed therearound at the end of the lower housing which is fitted into the upper housing 22. When the humidor 20 is in the fully extended configuration, the outwardly directed ridge 64 makes contact or collides with the inwardly directed ridge 62 thereby preventing the lower housing 24 from separating from the upper housing 22. Thus, the upper housing 22 and the lower housing 24 of the humidor 20 are constructed and assembled such that a substantially hermetic sliding seal is maintained between the upper housing 22 and the lower housing 24.

The exemplary humidor 20 shown in FIG. 5 has three ribs 33 on both sides of the lower housing 24. Preferably, the ribs 33 are substantially parallel to the inwardly directed ridge 62 and spaced a substantially equal distance apart. The spacing between the ribs 33 should be sufficiently large to permit the inwardly directed ridge 62 to rest in contact with the lower housing 24 in between adjacent ribs 33, thus maintaining the substantially hermetic seal of the humidor 20. Undesired sliding of the lower housing 24 into the upper housing 22 is minimized by contact between the ribs 33 and the inwardly directed ridge 62. It should be understood that the size, number and particular arrangement of the ribs 33 can be varied. Furthermore, the ribs 33 need only be placed on one side of the lower housing 24.

The upper housing 22 also includes an exterior surface 66 which is preferably, but not necessarily, substantially planar. The cigar humidor 20 also includes a cigar cutter 34 and means for detachably securing the cigar cutter 34 to the upper housing 22. The aforementioned securing means preferably comprises a plurality of ridges 68 formed on the exterior surface 66. Each ridge 68 includes a surface 72 which tapers toward the exterior surface 66 providing greater structural stability to the ridges 68 and eliminating a sharp edge which would otherwise be presented by the ridges 68.

As shown in FIG. 5, the plurality of ridges 68 are configured and positioned on the exterior surface 66 to provide a means for detachably securing the cigar cutter 34 to the upper housing 22. Generally, the means for detachably securing may be described as a "friction fit". More specifically, the ridges 68 are formed as rail members which are curved inwardly toward each other for receiving the cigar cutter 34 therebetween. Preferably, the ridges 68 are also formed on the exterior surface 66 to converge slightly from the bottom end of the upper housing 22 toward the lid 26 thereby effecting the aforementioned friction fit of the cigar cutter 34 between the ridges 68. The cigar cutter 34 shown in FIG. 5 is formed to include a surface complementary to the inner facing sides of the plurality of ridges 68. In this preferred embodiment, the cigar humidor 20 also includes a top ridge 69 positioned to support the hinge means for pivotally securing the lid 26 to the upper housing 22 or, more specifically, the second hinge member 30.

Referring now to FIG. 6 which is a cross-sectional view of the lower housing 24 taken along its plane 6—6 of FIG. 5, which best illustrates how the partitions 60 are fitted into the lower housing 24. The interior surface 56 is preferably contoured as shown defining the slots 58 within which the partitions 60 are fitted. The partitions 60 preferably comprise strips of Spanish cedar wood which impart a desirable aromatic quality and flavor to cigars stored within the humidor 20. In this embodiment, the boundaries of cylindrical portions 74*a*, 74*b*, 74*c* are defined by the interior surface 56 and the partitions 60. It should be understood that the interior surface 56 may by contoured differently than shown in FIG. 6. Furthermore, the number and geometric arrangement of the cylindrical portions 74 can be varied.

The pivotally mounted lid 26 of the cigar humidor 20 is best seen in the cross-sectional side view of FIG. 7. An enclosure 80 sized to receive a humidifying material is fitted within the lid 26. The enclosure 80 includes a tab portion 82 which is positioned against the lid 26 to retain the enclosure 80 within the lid 26 and to provide a means for easily removing the enclosure 80 from the lid 26. In the illustrated preferred embodiment, the tab portion 82 is slightly curved, formed from a semi-rigid plastic, and includes an outside face 84 upon which a plurality of bumps 86 are formed. The bumps 86 being molded integrally of the tab portion 82 cause it to have a curved shape to facilitate a user grasping the free end of the tab portion 82. The bumps 86 also serve to create a gap between the tab portion 82 and an interior surface 88 of the lid 26 and, for example, may be formed in a hemispherical or other conveniently manufactured shape. The aforementioned gap keeps the tab portion 82 from laying flush against the interior surface 88 thereby making the tab portion 82 easier to grasp with the fingers.

As best seen in FIG. 8, which is a partial crosssectional bottom view of the pivotally mounted lid 26 taken along the plane 8—8 of FIG. 7, a humidifying material 90 is fitted within the enclosure 80 provided in the lid 26. The humidifying material 90 may comprise a sponge-like material impregnated with a mixture of water and tensio-active substances which limit the potential of the evaporation of the water. The humidifying material 90 maintains a substantially constant relative humidity of the air within the humidor 20 and is available, for example, from Credo located at 34, rue Roussel Dorla, 13004 Marseille, France. The relative humidity of the air within the humidor 20 is a function of the composition of the aforementioned mixture. An exemplary impregnating solution comprises 4.15% of glycerol (glycerin) and 95.85% pure water.

The enclosure 80 additionally includes at least one porous surface 92 and an enclosure lid 94 as shown in FIG. 8. The sponge-like material 90 should be sized to fit properly within the enclosure 80 and, particularly, to accommodate any expansion of the material 90 after it is impregnated with the water/tensio-active substances mixture. The sponge-like material 90 is available, for example, from Smithers-Oasis U.S.A, P.O. Box 118, Kent, Ohio 44240, U.S.A.

The humidor 20 also includes means formed within the lid 26 for securing the enclosure 80 within the lid 26. The securing means may comprise, for example, a plurality of fins 96 formed within the lid 26 on the interior surface 88. The enclosure 80 should be sized to fit snugly within the securing means formed by the plurality of fins 96.

As best seen in FIG. 9, which is a cross-sectional rear view of the pivotally mounted lid 26 taken along the plane 9—9 of FIG. 7, the preferred humidor 20 additionally includes an indicator 98 for providing an indication of the relative humidity within the humidor 20. The relative humidity indicator 98 can be attached to the interior surface 88 or formed therein as best shown in FIG. 7.

The indicator 98 shown in FIG. 9 preferably includes at least three indicator regions 100 which each change color at a different relative humidity, for example: region 100*a*, 60%; region 100*b*, 70%; and region 100*c*, 80%. The indicator 98 also includes a background region 102. The region 100 closest in color to the color of the background region 102 indicates the relative humidity of the air inside the humidor 20. The relative humidity is ideal when the color of region 100b is the same as the color of the background region 102. The relative humidity is too low when the color of region 100*a* is the same as the color of the background region 102. When such a relative humidity reading is observed, water should be added to the sponge-like material 90 to reactivate the humidifying material. The relative humidity is too high when the color of region 100*c* is the same as the color of the background region 102. The relative humidity indicator 98 is available in the form of a humidity indicator card sold by Humidial Corporation, 926 So. 8th Street, Post Office Box 610, Colton, Calif. 92324-0610, U.S.A.

The exemplary humidifier enclosure 80, as best seen in FIG. 10, includes a porous surface 92 which is provided by a plurality of interstices 104 permitting the passage of water vapor into and out of the enclosure 80.

Referring to FIG. 11, an enlarged view of the upper housing 22 and the lid 26 is shown. The cigar cutter 34 is shown in phantom lines so that the spring member 39 is seen where it makes contact with the upper housing 22 as well as the lid 26. During assembly of the cigar humidor 20, the pin 32 is inserted through the coiled portion of the spring member 39 as well as through the first and second hinge members 28, 30.

As shown in FIG. 11, the upper housing 22 and the lid 26 are preferably formed with respective indented portions 110, 112 into which the ends of the spring member 39 are fitted during assembly of the cigar humidor 20. Referring to FIG. 12, a cross-sectional side view of the cigar humidor 20 taken along the plane 12—12 of FIG. 11 is shown. As best illustrated in FIG. 13 which is an enlarged side view of the hinge mechanism at circle 13 of FIG. 12, the indented portions 110, 112 are formed sufficiently deep within the upper housing 22 and the lid 26, respectively, to prevent excessive lateral movement of the spring 39 during operation of the hinge mechanism.

The ridge 68 is best illustrated in FIG. 14 which is a cross-sectional view of the cigar humidor 20 and its attached cigar cutter 34 taken along the plane 14—14 of FIG. 11. The ridge 68 includes an inner face 114 formed on the exterior surface 66. The inner face 114 extends from the exterior surface 66 to an inwardly curved portion 116 as shown in FIG. 14. The cigar cutter 34 includes a curved side 118 formed complementary to the inner face 114 and the inwardly curved portion 116. As discussed above, the cigar cutter 34 is frictionally fit between the two ridges 68. Thus, the respective dimensions of the cigar cutter 34 and the ridges 68 as well as the relative positions of the ridges 68 on the exterior surface 66 are to be appropriately selected.

Figure 15:
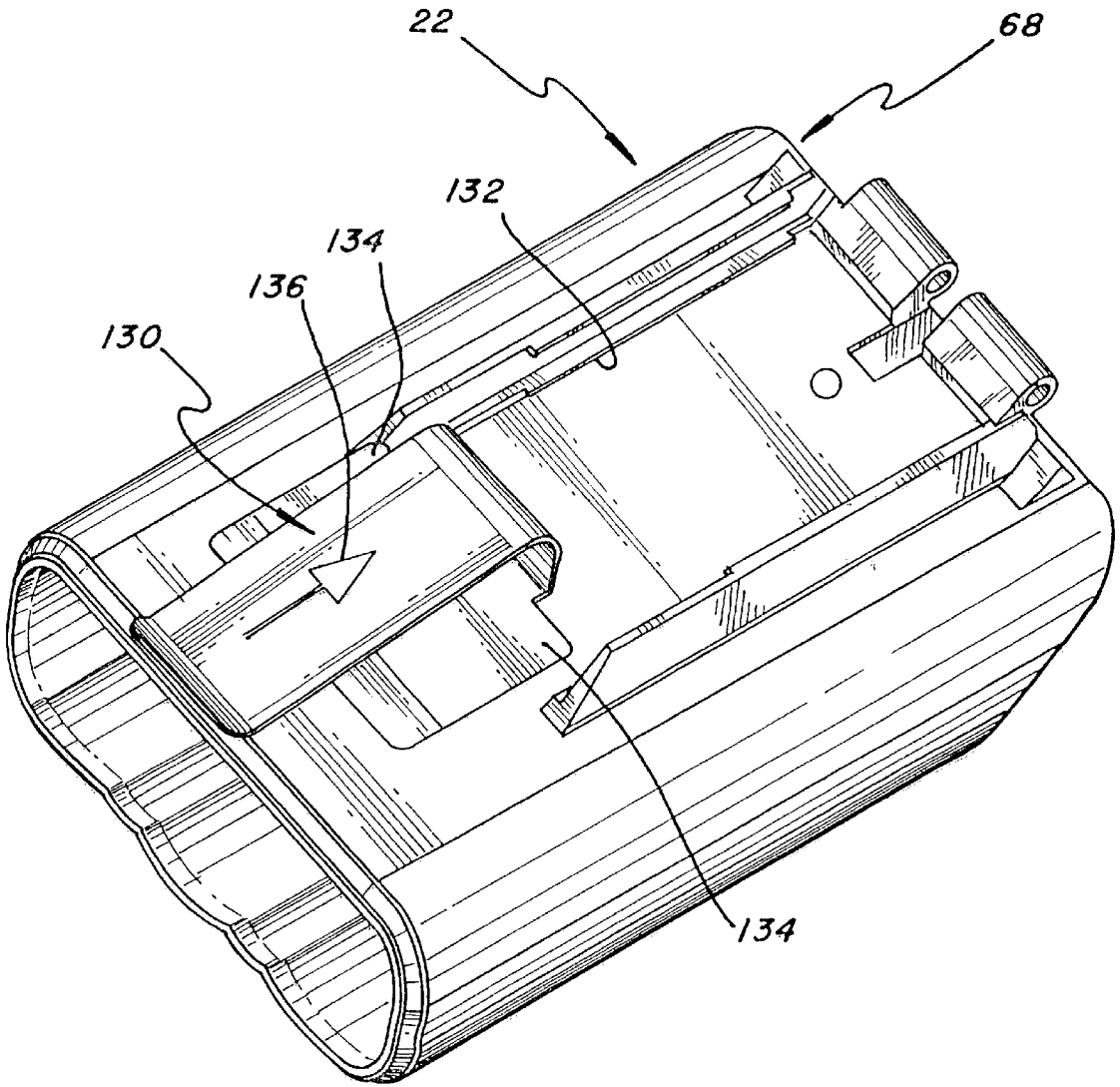
FIG. 15 is a perspective, rear view of the upper housing of an alternative preferred exemplary embodiment of the cigar humidor which further includes a clip member and wherein the ridges formed on the upper housing are adapted to receive both a cigar cutter and the clip member.

Another key aspect of the present invention is that an alternative preferred embodiment of the humidor 20 also includes a mechanism for securing the humidor 20 to an item of wearing apparel. FIG. 15 shows that this alternative humidor 20 includes a clip member 130 which is preferably made of steel, aluminum, or some other metal.

The alternative humidor 20 includes a plurality of ridges 68 substantially similar to those discussed with reference to FIG. 5. However, the alternative humidor 20 is different in that its plurality of ridges 68 are particularly adapted to define an undercut 132 into which a base portion 134 of the clip member 130 is slid along the direction indicated by arrow 136.

Figure 16:
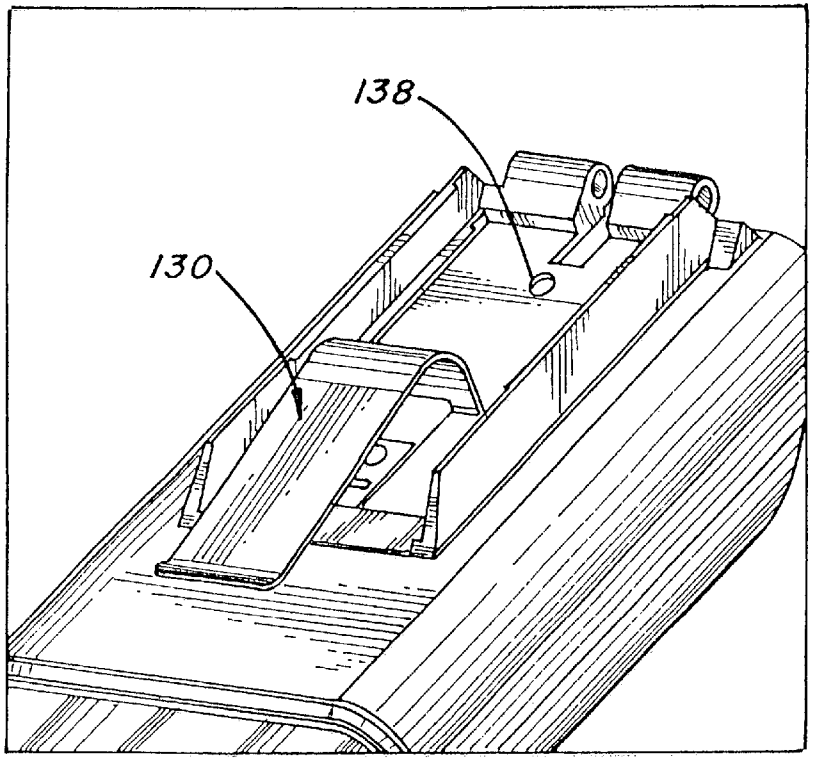
FIG. 16 is a perspective, rear view of the cigar humidor of FIG. 15 showing the clip member being slid beneath the undercut defined by the ridges on the upper housing.

FIG. 16 shows the clip member 130 being slid beneath the undercut 132 defined by the ridges 68 on the upper housing 22. The alternative humidor 20 also includes a ramped button 138 formed on the upper housing 22 as shown.

Figure 17:
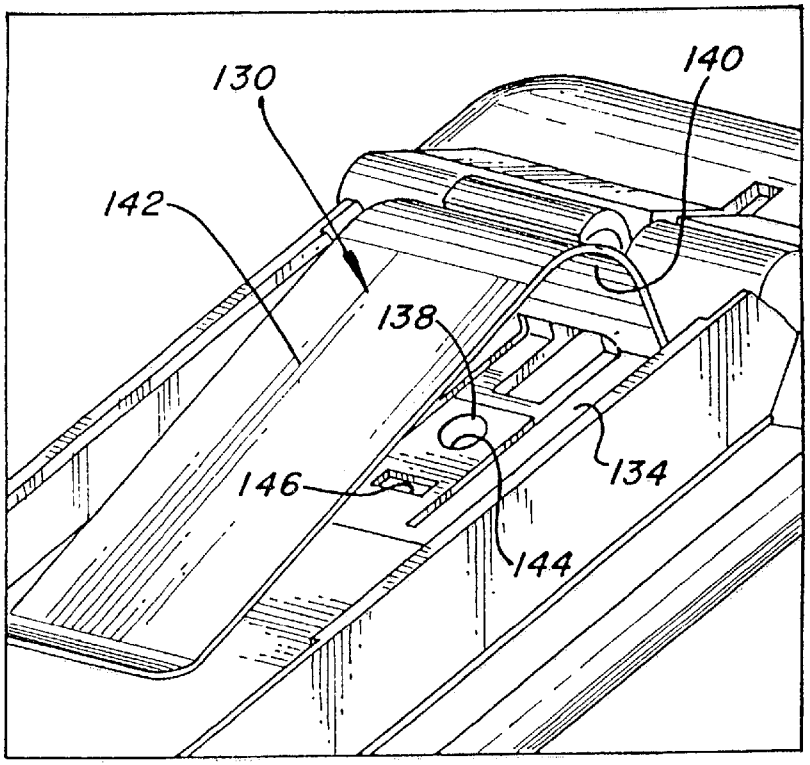
FIG. 17 is a perspective, rear view of the cigar humidor of FIG. 15 showing the clip member completely slid into the undercut defined by the ridges on the upper housing and secured therein by a ramped button on the upper housing.

Referring to FIG. 17, the clip member 130 is shown in greater detail. The clip member 130 also includes a flexing portion 140 which begins substantially perpendicular to the base portion 134 and eventually curves into a clipping portion 142. The base portion 134 includes a button aperture 144 and a slot 146. When the clip member 130 is completely slid into the undercut 132 it is secured therein by the ramped button 138 which emerges through the button aperture 144 as shown. To remove the clip member 130 from the upper housing 22, the ramped button 138 is depressed and the slot 146 employed to slide the clip member 130 out of the undercut 132.

Generally, the clip member 130 is streamlined, or "low profile", but should be formed with the clipping portion 142 positioned a sufficient distance from the ridges 68 to allow a belt, waist of a pair of pants, pocket, or the like to be fitted and secured between the clipping portion 142 and the ridges 68.

Figure 19:
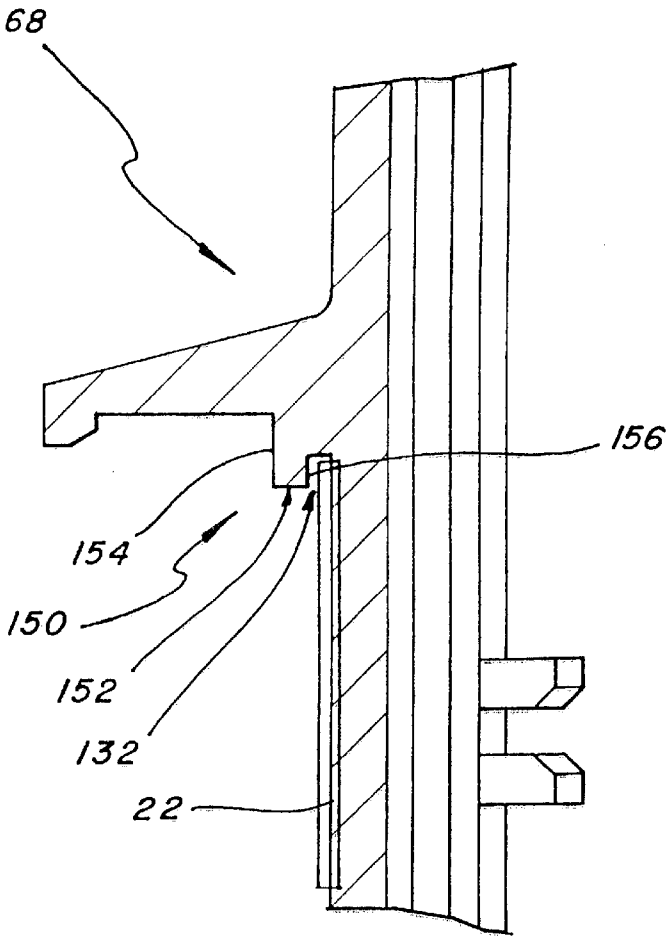
FIG. 19 is an enlarged cross-sectional top view at circle 19 of FIG. 18 showing the undercut defined by the ridges on the upper housing.
Figure 18:
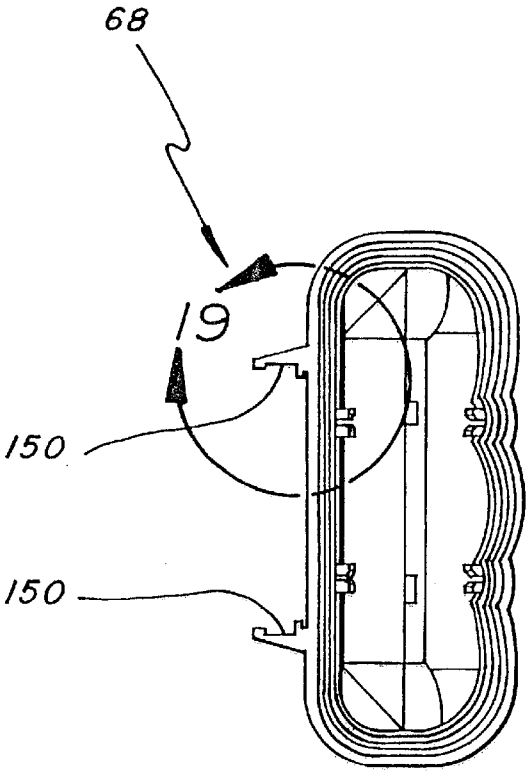
FIG. 18 is a cross-sectional top view of the cigar humidor of FIG. 15.

Referring to FIGS. 18 and 19, it can be seen that the ridges 68 of the alternative humidor 20 are adapted to hold the cigar cutter 34 (not shown) within a channel 150. A base ridge 152 defines the undercut 132. The base ridge 152 includes an upper surface 154 which is sufficiently far from the upper housing 22 so that the cigar cutter 34 supported thereby does not make contact with the ramped button 138. The base ridge 152 also includes a lower surface 156. A preferred undercut 132 measures approximately 0.025 inches from the lower surface 156 to the upper housing 22. The preferred clip member 130 has a base portion 134 which is sized sufficiently smaller in thickness to allow the clip member 130 to readily slide within the undercut 132.

In operation, the clip member 130 is first secured to the upper housing 22 as discussed above. Next, the clipping portion 142 is flexed away from the upper housing 22 so that the cigar cutter 34 can be slid into the channel 150. The shape and size of the channel 150 may be modified to accommodate different shapes and sizes of cigar cutters 34 or to secure them to the upper housing 22 in a different manner. Thus, the alternative cigar humidor 20 includes an integrally formed ridge structure on its upper housing 22 which is adapted to secure both a cigar cutter 34 and a belt clip mechanism 130 to the upper housing 22.

In conclusion, it is to be understood that the foregoing detailed description and the accompanying drawings illustrate the principals of the invention. However, various changes and modifications may be employed without departing from the spirit and scope of the invention. Thus, by way of example and not of limitation, materials other than those set forth with reference to the disclosed preferred embodiments may be employed. It is additionally contemplated that alternative mechanisms for securing the cigar cutter 34 and/or the clip member 130 to the upper housing 22 may be employed. Other mechanical changes such as the addition of a mechanism for locking the lid 26 to the upper housing 22 could also be made. Accordingly, the present invention is not limited to the specific form shown in the drawings and described in detail hereinabove.

What is claimed is:

1. A hand held portable humidor including a humidifying material for maintaining a substantially constant relative humidity within the humidor, the humidor comprising:

an upper housing including an exterior surface;

a lower housing formed of a material less rigid than said upper housing, said lower housing being telescopically fitted within said upper housing, said lower housing being sized sufficiently large relative to said upper housing and the material being sufficiently lubricative such that a sliding, substantially hermetic seal is maintained between said upper housing and said lower housing;

a cigar cutter;

a clip member; and a ridge structure integrally formed on said exterior surface, said ridge structure being adapted to detachably secure said cigar cutter and said clip member to said upper housing.

2. The hand held portable humidor of claim 1 wherein:

said ridge structure includes a base ridge with an upper surface defining a channel sized to receive and secure said cigar cutter to said housing and a lower surface defining an undercut;

said clip member includes a base portion sized to be fitted within said undercut.

3. The hand held portable humidor of claim 2 wherein:

said upper housing is formed with a button on said exterior surface; and said clip member is formed with a button aperture sized and positioned on said base portion such that said ramped button emerges therethrough when said base portion is slid into said undercut.

4. The hand held portable humidor of claim 3 wherein:

said button is ramped.

5. The hand held portable humidor of claim 2 wherein:

said upper surface is positioned a sufficient distance from said exterior surface such that said cigar cutter does not contact said button when said cigar cutter is secured within said channel.

6. The hand held portable humidor of claim 2 wherein:

said clip member further includes a flexing portion attached to said base portion and a clipping portion attached to said flexing portion.

7. The hand held portable humidor of claim 6 wherein:

said flexing portion extends substantially perpendicularly from said base portion and curves to meet said clipping portion.

8. The hand held portable humidor of claim 6 wherein:

said clip member is formed such that at least a portion of said clipping portion adjacent said flexing portion is positioned further from said housing than said ridge structure.

9. A hand held portable humidor including a humidifying material for maintaining a substantially constant relative humidity within the humidor, the humidor comprising:

an upper housing including a lid sized to receive the humidifying material, said upper housing including an inwardly directed ridge; and a lower housing formed of a material less rigid than said upper housing, said lower housing including at least one rib formed thereacross, said lower housing being telescopically fitted within said upper housing, with said at least one rib contacting said inwardly directed ridge when said lower housing is slid into said upper housing.

10. The hand held portable humidor of claim 9 wherein:

said at least one rib comprises a plurality of substantially parallel ribs.

11. A hand held portable humidor for cigars including a humidifying material for maintaining a substantially constant relative humidity within the humidor, the humidor comprising:

a housing including an exterior surface;

a lid pivotally secured to said housing and sized to receive the humidifying material;

a cigar cutter; and a receptacle formed on the exterior surface configured to receive and detachably secure said cigar cutter to said housing.

12. The hand held portable humidor of claim 11 wherein:

said receptacle comprises a plurality of ridges formed on said exterior surface.

13. The hand held portable humidor of claim 12 wherein:

said plurality of ridges define a channel sized to receive and secure said cigar cutter to said housing.

14. The hand held portable humidor of claim 12, further comprising a removable clip member wherein:

said plurality of ridges define an undercut; and said clip member includes a base portion sized to be fitted within said undercut.

15. The hand held portable humidor of claim 14 wherein:

said clip member further includes a flexing portion attached to said base portion and a clipping portion attached to said flexing portion.

16. The hand held portable humidor of claim 15 wherein:

said flexing portion extends from said base portion and curves to meet said clipping portion.

17. The hand held portable humidor of claim 15 wherein:

said clip member is formed such that at least a portion of said clipping portion is positioned further from said housing than said ridges.

18. The hand held portable humidor of claim 12, further comprising:

a clip member; and wherein said plurality of ridges define:

a channel sized to receive and secure said cigar cutter to said housing; and an undercut adapted to receive and secure said clip member to said housing.

19. The hand held portable humidor of claim 18 wherein:

said undercut is positioned closer to said housing than said channel.

20. The hand held portable humidor of claim 18 wherein:

said plurality of ridges include a base ridge with an upper surface and a lower surface, said upper surface defining a portion of said channel, said lower surface defining a portion of said undercut.

* * * * *